US008778160B2

(12) United States Patent
Pant et al.

(10) Patent No.: US 8,778,160 B2
(45) **Date of Patent: *Jul. 15, 2014**

(54) METHOD AND APPARATUS FOR SEPARATING PARTICLES BY DIELECTROPHORESIS

(75) Inventors: Kapil Pant, Huntsville, AL (US); Yi Wang, Huntsville, AL (US); Ketan Bhatt, Huntsville, AL (US); Balabhasker Prabhakarpandian, Huntsville, AL (US)

(73) Assignee: CFD Research Corporation, Huntsville, AL (US)

( * ) Notice: Subject to any disclaimer, the term of this patent is extended or adjusted under 35 U.S.C. 154(b) by 213 days.

This patent is subject to a terminal disclaimer.

(21) Appl. No.: 13/190,882

(22) Filed: Jul. 26, 2011

(65) Prior Publication Data

US 2012/0312690 A1 Dec. 13, 2012

Related U.S. Application Data

(63) Continuation-in-part of application No. 11/167,428, filed on Jun. 27, 2005, now Pat. No. 7,998,328.

(51) Int. Cl.
*B03C 5/02* (2006.01)
*B03C 5/00* (2006.01)

(52) U.S. Cl.
CPC . *B03C 5/02* (2013.01); *B03C 5/005* (2013.01); *B01L 2400/0424* (2013.01); *B03C 5/022* (2013.01)
USPC ..... 204/643; 204/450; 204/600; 204/547

(58) Field of Classification Search
CPC ..... B01L 2400/0424
USPC ..... 204/450–454, 547, 600–602, 604, 643
See application file for complete search history.

(56) References Cited

U.S. PATENT DOCUMENTS 6,641,708 B1 * 11/2003 Becker et al. ..... 204/547
6,727,451 B1 * 4/2004 Fuhr et al. ..... 209/130

OTHER PUBLICATIONS

Kim, Byoung-Gyun, Kwang-Seok Yun, and Euisik Yoon. "Active Positioning Control of Single Cell/Microbead in a Micro-Well Array Chip by Dielectrophoresis." MEMS 2005 Miami Technical Digest. Proc. of 18th IEEE International Conference on Microelectromechanical Systems, Miami Beach, FL. 702-05.*

* cited by examiner

*Primary Examiner* — Keith Hendricks
*Assistant Examiner* — Kourtney S Carlson
(74) *Attorney, Agent, or Firm* — Maschoff Brennan, PLLC

(57) ABSTRACT

Particle separation apparatus separate particles and particle populations using dielectrophoretic (DEP) forces generated by one or more pairs of electrically coupled electrodes separated by a gap. Particles suspended in a fluid are separated by DEP forces generated by the at least one electrode pair at the gap as they travel over a separation zone comprising the electrode pair. Selected particles are deflected relative to the flow of incoming particles by DEP forces that are affected by controlling applied potential, gap width, and the angle linear gaps with respect to fluid flow. The gap between an electrode pair may be a single, linear gap of constant gap, a single linear gap having variable width, or a be in the form of two or more linear gaps having constant or variable gap width having different angles with respect to one another and to the flow.

24 Claims, 6 Drawing Sheets

METHOD AND APPARATUS FOR SEPARATING PARTICLES BY DIELECTROPHORESIS

FEDERALLY SPONSORED RESEARCH OR DEVELOPMENT

The U.S. Government may have certain rights in this invention pursuant to the following contract number: USMCSC M67854-03-C-5015 and M67854-04-C-5020; DHS. NBCHC060070; and NASA NNX09CB76C.

CROSS-REFERENCE TO RELATED APPLICATIONS

This application claims priority under 35 U.S.C. 120 to application Ser. No. 11/167,428 filed Jun. 27, 2005, which is incorporated by reference in its entirety.

BACKGROUND OF THE INVENTION

1. Field of the Invention

This invention relates to microfluidic systems, apparatus, and methods for handling or processing fluid suspensions of dielectric particles including living cells, spores, viruses, polymer beads, and aggregates of macromolecules. In particular, the invention involves the use of dielectrophoresis (DEP) induced forces to manipulate or control the velocity, including direction, of dielectric particles in microfluidic devices.

2. Description of Related Art

U.S. Ser. No. 11/167,428 discloses arrangements of electrodes used to engineer microfluidic devices that achieve programmable, high efficiency particle separations. The particles are separated in a separation chamber comprising at least one pair, or preferably two opposing pairs, of electrodes that generate c-DEP forces, which act on a mixture of particles in a suspending medium. Particles are deflected and/or blocked by DEP forces generated by the electrodes. Particles deflected by the two pairs of electrodes can be shunted into a side channel for further concentration and analysis. Alternatively, particles blocked by two pairs of electrodes can be released by changing the applied c-DEP forces. The separation chamber can be tuned to trap/separate different types of particles by altering the voltages, AC frequencies, and/or the spacing between electrode pairs.

A feature that distinguishes the invention disclosed in U.S. Ser. No. 11/167,428 from other DEP separation techniques using coupled electrode pairs is the electrode configuration of the electrically coupled electrode pair. Applying an electric potential to an electrically coupled pair of electrodes adjacent to one another on the same surface results in a electric and DEP fields that are completely different from the fields generated when a potential is applied to a pair of electrodes located opposite one another. FIG. 1 shows the electric field lines FL and isopotential contours IC generated by electrodes conventionally located on opposing surfaces (FIG. 1A) and those generated by adjacent, electrically coupled electrodes located on the same surface (FIG. 1B) as in the used in the present invention. FIG. 1B shows two pairs of electrodes so that the advantages of two pairs of electrodes located opposite one another can be explained but the use of two pairs of electrodes, while preferred, is not required.

Methods and devices using an electrically coupled electrode pair 33, 34 arranged in opposition (FIG. 1A) generate a pattern of electric field lines FL that traverse the flow channel between them. Methods and devices using adjacent, electrically coupled electrodes pairs 3,4 and 13,14 separated by a gap distance arranged (FIG. 1B) generates field lines FL that originate and terminate on the same side of the flow channel. The electric field and isopotential geometries shown in FIG. 1B cannot be produced by any combination of electrode pairs that are electrically coupled and on opposite sides of the flow channel. The isopotential contours IC and potential gradients generated by the two electrode arrangements also differ. The magnitude of the potential gradients are proportional to the spacing between isopotential lines in FIG. 1. A particle moving from left to right in the flow channel experiences a much higher and more symmetrical potential gradient when the electrodes are arranged as in FIG. 1B than it does when the electrodes are arranged as in A. The higher, more symmetric potential gradient resulting from consecutive, electrically coupled electrodes that are adjacent to one another and separated by a gap distance as shown in FIG. 1B provides more effective separation than the potential gradient shown in FIG. 1A. The electric field strengths in both cases can be increased by moving the coupled electrodes closer together while applying the same constant or by increasing the applied potential. Moving the coupled electrodes closer together requires reducing the flow channel dimensions for oppositely arranged electrodes as in FIG. 1A but not for pairs of adjacent electrodes as in FIG. 1B. Consequently, devices with the electrode configuration shown in FIG. 1B can operate at lower applied potentials while maintaining higher flow volumes and flow rates than devices with the electrode configuration shown in FIG. 1A. The use of lower applied voltages reduces the risk of damaging cells, viruses, and other biological particles being separated.

The DEP force produced by the electrode configuration in FIG. 1B can be adjusted by altering the electrode gap distance, the electrode geometry, channel geometry, the potential and/or frequency and/or waveform of the applied potential. The flow rate determines the hydrodynamic force acting on the particles, which is strong enough for non-selected particles to overcome the lateral DEP force at each set of electrodes while selected particles are halted or diverted into one or more side channels.

The invention disclosed in U.S. Ser. No. 11/167,428 discloses a separation chamber comprising a flow channel comprising a single pair of consecutive, electrically coupled, planar electrodes at the bottom surface of a flow channel or two pairs of consecutive, electrically coupled, planar electrodes are placed on opposite surfaces of a flow channel. The DEP force generated by a single pair of electrodes levitates selected particles and can be used to prevent selected particles from traversing the electrodes to divert them into a side channel or to prevent them from leaving the flow channel. The lateral component of the DEP force can be used to enhance the motion of particles into a side channel. The magnitudes of the levitating and lateral forces used to capture and/or divert particles decrease as distance from the coupled electrode pair increases. An additional pair of consecutive, electrically coupled planar electrodes can be placed on an opposite side of a flow channel from a first electrode pair. Opposing electrode pairs allow for higher flow volumes because the height of the flow channel can be increased while maintaining the same DEP forces without increasing the potential applied to the electrodes. Alternatively, the configuration of the opposing electrode pairs can be used to strengthen the DEP forces relative to the single electrode pair configuration.

The electrode configurations disclosed in U.S. Ser. No. 11/167,428, while an improvement over previous electrode configurations, do not provide for the separation of more than two populations of particles. Additionally, hydrodynamic flows in some circumstances can reduce the efficiency of separation and cause contamination of selected particles by non-selected particles.

BRIEF SUMMARY OF THE INVENTION

The present invention provides apparatus and methods for the simultaneous separation of two or more populations of particles having, or made to have, different dielectric properties. The present invention also provides apparatus and methods that, relative to previous DEP separation techniques, improve the efficiency of particle separation and reduce contamination of selected particles. The present invention is based, in part, on novel electrode configurations capable of separating more than two populations of particles in a single pass though a separation chamber and novel separation chamber geometries that reduce contamination resulting from disadvantageous hydrodynamic flows.

The invention can be employed in a wide variety of applications including, but not limited to, the processing, separation and/or concentration of analyte mixture components containing living, non-living, transformed, and/or malfunctioning cells, polymer beads, bacterial or fungal spores, and macromolecules. This invention is capable of separating and concentrating particles based on particle size as well as the electrical properties of the particles.

The invention is described in more detail below. Those skilled in the art will recognize that the examples and embodiments described are not limiting and that the invention can be practiced in many ways without deviating from the inventive concept.

DETAILED DESCRIPTION OF THE INVENTION

Figure 2:
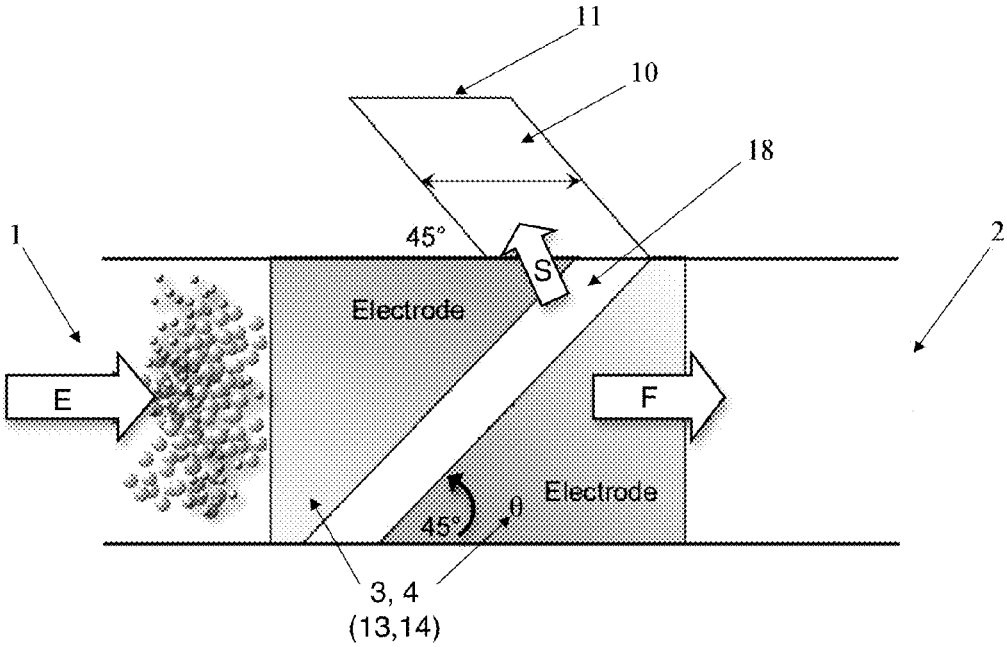
FIG. 2 is a top view of a DEP separation device according to U.S. Ser. No. 11,167,428.
Figure 4:
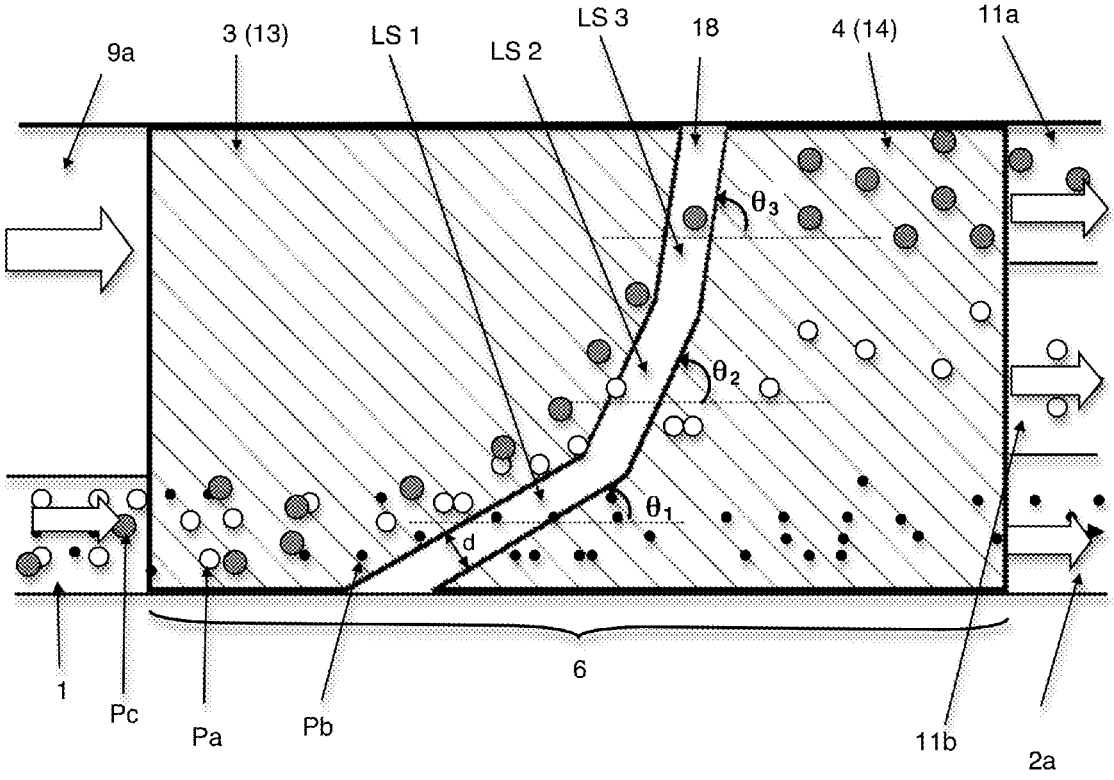
FIG. 4 is a top view of a separation chamber comprising planar electrodes separated by a nonlinear gap comprising three linear sections oriented to form different angles with respect to the direction of flow.

FIG. 2 shows the top view of one embodiment of a separation chamber disclosed in U.S. Ser. No. 11/167,428. The dimensions of the separation chamber may vary depending on the particles present in the mixture being separated or concentrated. For example, main channels may have a range of heights from about 1.0 mm to 1.0 cm and a range of widths from about 1.0 mm to about 1.0 cm. The velocity of fluid approaching the electrode may be as high as 1 mm/s. Exemplary embodiments have widths and heights ranging from 10 mm to 200 mm to 400 mm 800 mm. The device comprises one pair of electrically coupled, planar, wedge-shaped electrodes 3, 4 with parallel facing edges forming a gap 18 having a constant gap distance. The gap distance is in the range of 1.0 mm and 1.0 cm with preferred embodiments ranging from 1.0 mm to 10 mm to 100 mm to 1 cm. The figure depicts only one pair of electrodes 3 and 4, which are preferably located on the bottom surface of the flow channel but may alternatively be located on the top surface of the flow channel. The flow channel may additionally comprise a second pair 13, 14 of electrically coupled, planar electrodes located directly on the opposite side of the flow channel in or on the upper surface of the flow channel. When present, the second pair of electrodes would, in the top view shown in FIG. 2, eclipse the pair of electrodes in or on the bottom surface of the separation chamber. This is indicated by placing the reference numbers 13, 14 for the second electrode pair in parentheses. The separation chamber may additionally comprise multiple side channels and multiple sets of electrode pairs for directing different selected particles into each of the side channels. The potentials applied to the electrodes may range from 0.1 to 1,000 volts. The region of the separation chamber containing electrodes 3,4 (13,14) where DEP forces act on particles forms a separation zone 6 (FIG. 4).

During operation of the separation shown in FIG. 2, a mixture of particles suspended in a fluid enters the separation chamber through inlet 1. A c-DEP force generated by applying a voltage to the electrode pair 3, 4 levitates and deflects selected particles into the proximal end of the side channel 10 and on to the side outlet 11 at the distal end of the side channel. The opening at the proximal end of the side channel is normally positioned to overlap at least a portion of the gap between electrodes and the trailing edge of the first electrode encountered by the particles. The flow of non-selected particles is unaffected or directed by c-DEP forces to continue through the main channel of the separation chamber to outlet 2. The separation chamber may be tuned to separate selected particles based on their sizes or electrical properties by adjusting the gap 18 between electrodes, applied voltage, and/or the frequency of alternating applied voltage. Open block arrows in the figure represent hydrodynamic fluid flows entering the separation chamber E, moving through the chamber to the outlet O, and entering the side channel S. All of the fluid flowing through side channel 10 enters from the flow channel, resulting in a net flow of fluid from the main flow channel into the side channel 10. The net flow of fluid into the side channel from the main flow channel creates a hydrodynamic flow S that can drag non-selected particles (particles not being deflected by the c-DEP force) into the side channel 10.

An electrically coupled electrode pair is connected to a power source (not shown) and the electrodes 3,4 (13,14) of the pair have opposite potentials at any given time. The potential applied to an electrode pair can be a constantly applied direct electric field (DC field) characterized by the magnitude of applied voltage; a time varying, direct electric filed (DC) characterized by the magnitude, frequency, and waveform of the applied voltage, and a having a waveform that can be sinusoidal, square, pulse, saw-toothed, or combination thereof; or an alternating electric field (AC field) characterized by the magnitude, frequency, and waveform of the applied voltage and a waveform that can be sinusoidal, square, pulse, saw-toothed or combinations thereof.

Figure 3:
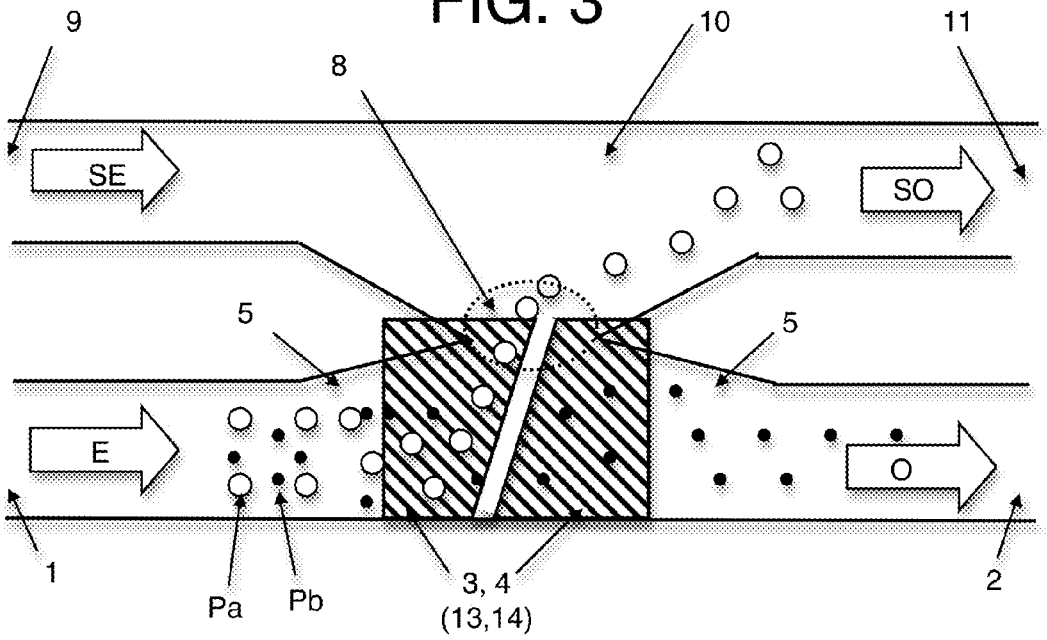
FIG. 3 is a top view of one embodiment of a separation chamber configuration according to the present invention providing reduced contamination of selected particles by non-selected particles relative to the separation chamber geometry shown in FIG. 2.

FIG. 3 shows a top view of an embodiment of the present invention having generally the same electrode geometry and configuration as shown in FIG. 2, but having a different separation chamber geometry that reduces or eliminates contamination caused by hydrodynamic flows dragging, or entraining, non-selected particles into a side channel. The separation chamber comprises a sample flow channel 5 and a side channel 10. Sample flow channel 5 and side channel 10 are configured such that fluid flow in the two channels is approximately parallel and are in fluid communication through an opening 8 (within dashed ellipse) that overlaps electrode pair 3, 4. The opening 8 is formed by a region in which a portion of a wall of Sample flow channel 5 and a portion of a wall of side channel 10 extend toward one another. The relative positions of the opening 8 and the electrode pair 3, 4 places the electrode gap in the opening such that particles deflected by DEP forces generated when electric potential is applied to the electrodes 3, 4 are passed through the opening 8 from the sample flow channel 5 into the side channel 10.

During the operation of the separation chamber, a fluid sample comprising two particle populations Pa, Pb enters the sample flow channel 5 through inlet 1. A potential applied to electrode pair 3, 4 generates a c-DEP force that deflect particles Pa into the side channel 10 through opening 8 as the fluid sample passes over the electrode pair 3, 4. Non-selected particles, in this case Pb, are carried out of the sample flow channel through outlet 2 and selected particles, in this case Pa, are carried out of the side channel through outlet 11. Open block arrows represent hydrodynamic fluid flow in the separation chamber. By balancing the hydrodynamic fluid flow through the sample flow channel 5 and the side channel 10, a net fluid flow between these channels can be prevented and contamination of the side channel with non-selected particles (i.e. particles not deflected by a DEP force) can be reduced or eliminated. Controlling the hydrodynamic flow entering the sample flow channel E with the hydrodynamic flow entering the side channel SE and/or controlling the hydrodynamic flow out of the sample flow channel O with the hydrodynamic flow out of the side channel SO prevents a net fluid flow between the two channels. The hydrodynamic flows may be controlled, for example, using pumps, valves, flow channel geometries, and combinations thereof. Fluid flow velocities and channel geometries near the opening 8 are preferably controlled to prevent turbulent flow in the region of the opening 8.

Figure 1:
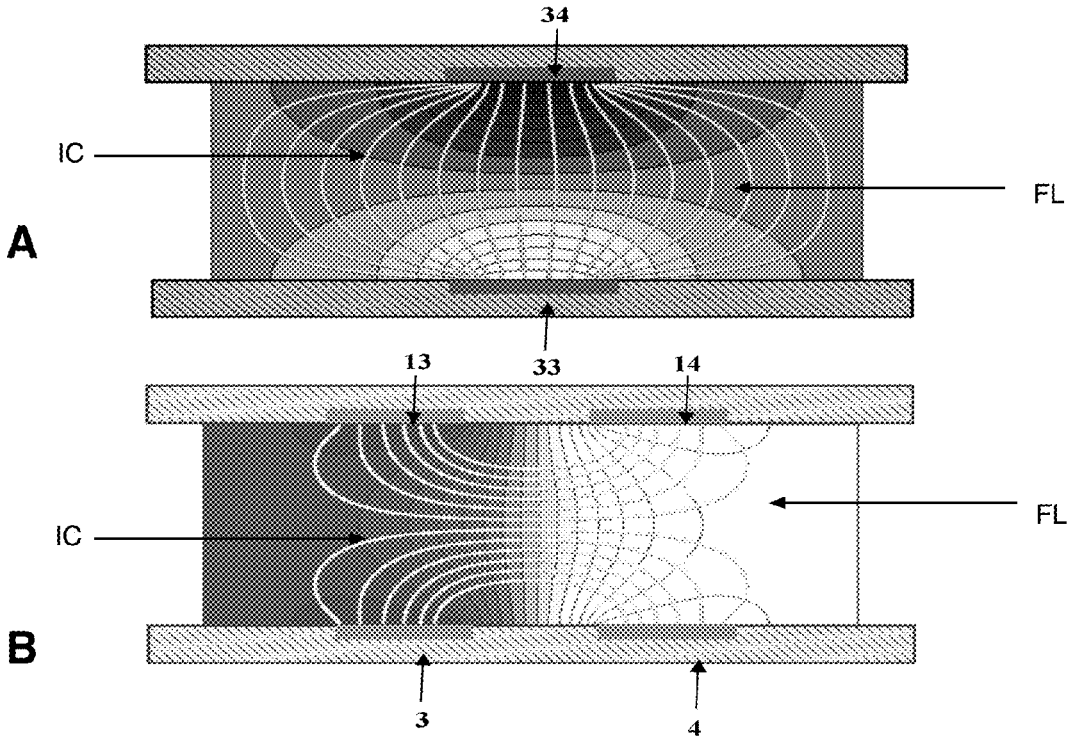
FIG. 1 illustrates difference between the electric field geometries produced by an opposing electrode pair and adjacent electrode pairs.

The separation chamber shown in FIG. 3 may comprise a second pair of electrodes 13, 14 located in or on the top surface of the sample flow channel 5 directly opposite electrode pair 3, 4 located in or on the bottom of the sample flow channel, as shown in FIG. 1. The angle θ formed between the linear electrode gap and the direction of flow in the sample flow channel 5 may be 45° as shown in FIG. 2 or in a range of from 0° to 90°, preferably between 30° and 60°. The opening 8 between the sample flow channel 5 and the side channel 10 may be formed by constructing the flow channels such that portions of their walls extend toward one another as shown in FIG. 3. Other geometries, including variations in the angles with which the channel walls join one another and curved walls as opposed to or in addition to straight walls may be used to form the opening 8 in such a way as to minimize turbulent fluid flow. Two particle populations are shown in FIG. 3 for illustrative purposes. The sample entering sample flow channel 5 through inlet 1 may contain any number of particle populations. Similarly, the electrodes may be used to deflect more than one population of particles from the sample flow channel into the side channel.

FIG. 4 shows a top view of a separation chamber comprising a separation zone 6 located over an electrode pair 3, 4 (or between electrode pairs 3, 4 and 13, 14). A sample fluid inlet 1 and a side channel inlet 9*a* are configured to deliver fluids to the separation zone 6 and is configured to deliver a sample comprising particles suspended in a fluid to the separation zone 6. Sample outlet 2*a*, and side channel outlets 10*a*, 10*b* are configured to receive fluid from the separation zone 6. The sample fluid inlet 1 is configured to deliver a sample comprising particles suspended in a fluid to separation zone 6 in such a way that non-selected particles unaffected by DEP forces flow through the separation zone and into outlet 2*a*. The electrodes 3, 4 have geometries that form a nonlinear electrode gap 18 having a constant gap distance d. The nonlinear gap 18 comprises three linear sections LS1, LS2, LS3, each with constant gap distance d. Linear sections LS1, LS2, LS3 form angles $\theta_1$, $\theta_2$, $\theta_3$, with respect to the axis of flow (dashed lines) from inlet 1 to outlet 2*a*. The gap distance is the same for the three linear sections shown in FIG. 4, but the gap distances may also different for different linear sections.

During the operation of the separation chamber, a fluid sample comprising three particle populations Pa, Pb, Pc enters the separation zone 6 through inlet 1. A potential applied to electrode pair 3, 4 generates a c-DEP force along each of the three segments of the nonlinear gap 18. Particles to be selected, in this case Pa and Pc, are deflected by a DEP force generated at the linear gap section having an angle $\theta_1$ with respect to the direction of fluid flow when an electrical potential is applied to electrodes 3, 4. Particles Pc are deflected by a DEP force generated at the linear gap section having an angle $\theta_2$ while particles Pa flow into side channel outlet 11*b*. Particles Pc flow into side channel outlet 11*a*. Non-selected particles, in this case Pb, are carried out of the separation zone 6 through outlet 2*a*. Open block arrows represent hydrodynamic fluid flow in the separation chamber. The hydrodynamic fluid flows entering the separation zone 6 through sample inlet 1 and side channel inlet 9*a*, and exiting the separation zone 6 through sample outlet 2*a* and side channel outlets 11*a* and 11*b* are balanced to produce laminar fluid flow through the separation zone 6. By maintaining laminar, non-turbulent flow through the separation zone, the entrainment of particles in lateral fluid flows is prevented and cross-contamination of selected and/or non-selected particles is minimized. Balancing of the hydrodynamic flow entering and exiting the separation zone 6 may be controlled using pumps, valves, flow channel geometries, and combinations thereof.

Figure 5:
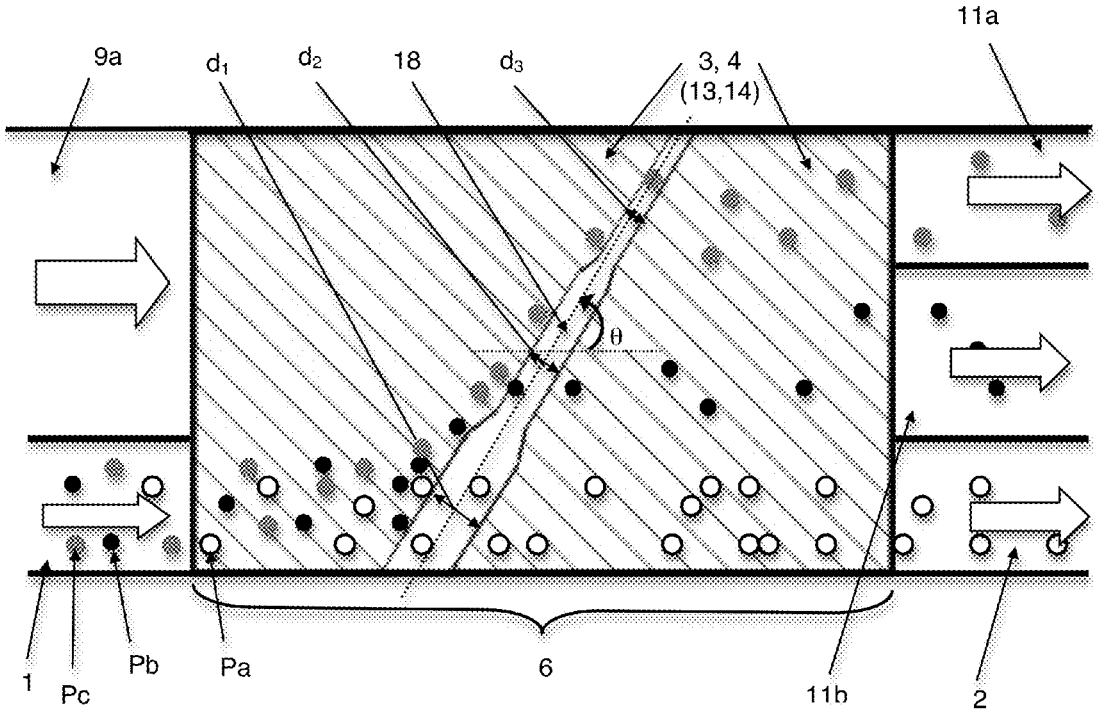
FIG. 5 is a top view of a separation chamber comprising planar electrodes separated by a linear gap having three different gap distances.
Figure 7:
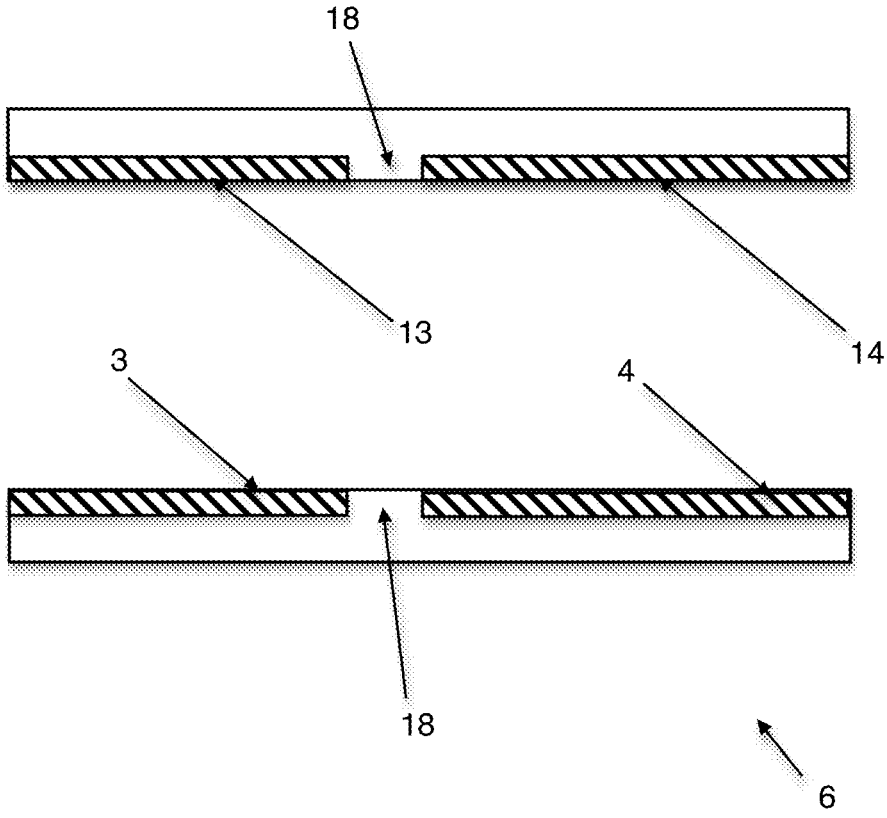
FIG. 7 shows a planar cross-sectional view of a separation zone.

The separation chamber shown in FIG. 4 may comprise a second pair of electrodes 13, 14 located in or on the top surface of the separation zone 6 directly opposite electrode pair 3, 4 located in or on the bottom of the sample flow channel, as shown in FIG. 7. Because FIG. 4 is a top view, the second pair of electrodes 13, 14 would eclipse the first pair of electrodes 3, 4. The optional presence of the second pair of electrodes 13, 14 is indicated in the figure by parentheses. The angles $\theta_1$, $\theta_2$, $\theta_3$ formed between the linear electrode gap segments and the direction of flow in the separation zone 6 are in a range of from 0° to 90°, preferably between 15° and 75°. Three particle populations are shown in FIG. 4 for illustrative purposes. The sample entering the separation zone 6 through inlet 1 may contain any number of particle populations. Similarly, the electrodes may be used to deflect more than one population of particles from the sample flow channel into the side channel. The number of linear sections in the non-linear electrode gap 18 may be more than three. The number and positions of side channel outlets may vary depending on the specific geometry of the electrode pair(s) 3, 4 (13, 14). Increasing the number of linear gap segments increases the number of particle populations that can be separated in one pass through the separation zone 6. FIG. 5 shows a top view of a separation chamber comprising a separation zone 6, an electrode pair 3, 4, a sample fluid inlet 1, a side channel inlet 9*a*, a sample outlet 2*a*, and side channel outlets 11*a* , 11*b* configured similarly to the embodiment shown in FIG. 4. The electrodes 3, 4 have geometries that form a linear electrode gap 18 having three distinct gap distances $d_1$, $d_2$, $d_3$. During the operation of the separation chamber, a fluid sample comprising three particle populations Pa, Pb, Pc enters the separation zone 6 through inlet 1. A potential applied to electrode pair 3, 4 generates a c-DEP force along each of the three segments of the linear gap 18. Particles to be selected, in this case Pb and Pc, are deflected by a DEP force generated at the linear gap section having a gap distance $d_1$ when an electrical potential is applied to electrodes 3, 4. Particles Pc are deflected by a DEP force generated at the linear gap section having a gap distance $d_2$ while particles Pb flow into side channel outlet 11*b*. Particles Pc flow into side channel outlet 11*a* . Non-selected particles, in this case Pa, are carried out of the separation zone 6 through outlet 2*a*. Open block arrows represent hydrodynamic fluid flow in the separation chamber. The hydrodynamic fluid flows entering the separation zone 6 through sample inlet 1 and side channel inlet 9*a*, and exiting the separation zone 6 through sample outlet 2*a* and side channel outlets 11*a* and 11*b* are balanced to produce laminar fluid flow through the separation zone 6. By maintaining laminar, non-turbulent flow through the separation zone, the entrainment of particles in lateral fluid flows is prevented and cross-contamination of selected and/or non-selected particles is minimized. Balancing of the hydrodynamic flow entering and exiting the separation zone 6 may be controlled using pumps, valves, flow channel geometries, and combinations thereof.

The separation chamber shown in FIG. 5 may comprise a second pair of electrodes 13, 14 located in or on the top surface of the separation zone 6 directly opposite electrode pair 3, 4 located in or on the bottom of the sample flow channel, as shown in FIG. 1. Because FIG. 5 is a top view, the second pair of electrodes 13, 14 would eclipse the first pair of electrodes 3, 4. The optional presence of the second pair of electrodes 13, 14 is indicated in the figure by parentheses. The angle θ formed between the linear electrode gap 18 and the direction of flow in the separation zone 6 is a range of from 0° to 90°, preferably between 30° and 60°. Three particle populations are shown in FIG. 5 for illustrative purposes. The sample entering the separation zone 6 through inlet 1 may contain any number of particle populations. Similarly, the electrodes may be used to deflect more than one population of particles from the sample flow channel into the side channel. The number of segments with distinct gap distances in the linear electrode gap 18 may be more than three. The number and positions of side channel outlets may vary depending on the specific geometry of the electrode pair(s) 3, 4 (13, 14). Increasing the number of linear gap segments increases the number of particle populations that can be separated in one pass through the separation zone 6.

Figure 6:
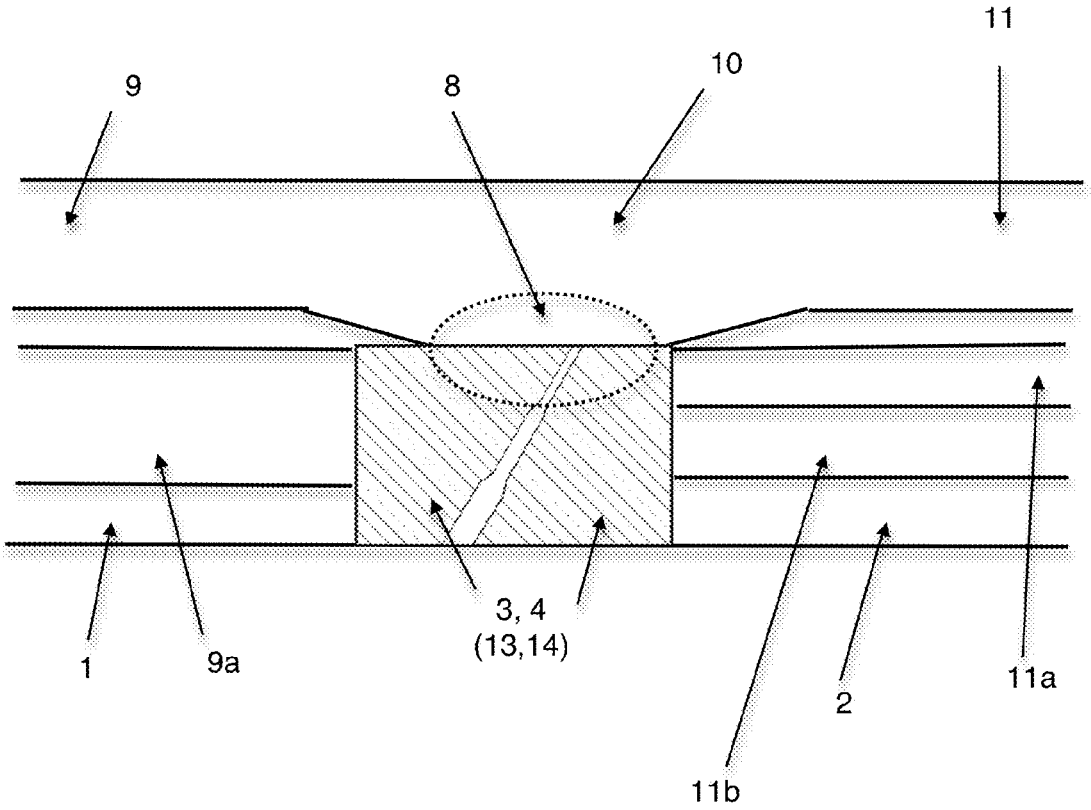
FIG. 6 is a top view of a separation chamber combining the configurations of the separation chambers shown in FIG. 3 and FIG. 5.

It is, of course, possible to combine the separation chamber configuration shown in FIG. 3 with the configurations and electrode geometries shown in FIG. 4 and/or FIG. 5, as shown in FIG. 6.

The velocity of fluid approaching the electrode pair(s) 3, 4 (13, 14) may be as high as 1 mm/s. The dimensions of the separation chamber may vary depending on the particles being separated or concentrated. The height of a sample flow channel 5 or a separation zone 6 is preferably from 1.0 μm to 1.0 cm and the width preferably from 1.0 μm to 1.0 cm. Exemplary embodiments have widths and heights ranging from 10 μm to 200 μm to 400 μm 800 μm. The gap 18 between electrodes may be constant or variable in the range of from 1.0 μm to 1.0 cm with preferred embodiments ranging from 1.0 μm to 10 μm to 100 μm to 1 mm. The potentials applied to the electrodes may range from 0.1 to 1,000 volts.

Particle Separations:

The particles may be separated based upon their sizes or different electrical properties such as different compositions in the plasma membranes or contents of cells. When cells are being separated or processed, the suspending liquid is normally an aqueous buffer. It is also possible to separate biological particles from non-biological particles and living cells from non-living cells based upon the different dielectric properties of the particles being separated. The particles separated using the apparatus and method described herein may be cells, polymer beads, lipisomes, liposomes, viruses, spores, and/or combinations thereof and may be reversible, irreversibly, and or selectively tagged with substances to alter their electric or dielectric properties. Tagging may be accomplished by reversible binding with an antibody, irreversibly cross-linking with a substrate or substrate analog, or other known methods for tagging particles. The applied potential, gap distance, and/or conductivity of suspending fluid may be modified to separate desired particles or groups of articles having a selected value or range of values for dielectric properties that may be associated with or more properties such as size, cell membrane porosity, presence or absence of a tag, and composition of the particles. The present method and apparatus may also be combined with assays wherein selected and/or non-selected particles are directed into assay apparatus such as particle adhesion, delivery, and migration assays, as descried in U.S. patent application Ser. Nos. 11/331,715; 12/428,134; 12/612,573; 12/648,296; and 12/726,140, which are incorporated by reference.

Post-Separation and Multi-Selection Handling:

Non-selected particles collected from outlet 2 in FIGS. 2 and 3 or from outlet 2*a* in FIGS. 4 and 5 can be recycled into the system via sample inlet 1. AC signals applied to electrode pair(s) 3, 4, (13, 14) can be adjusted to block the next type of particle to be selected. Additionally or alternatively, one may serially arrange separation chambers to receive fluid suspensions from flow channel and/or side channel outlets of upstream separation chambers. The electric fields may be adjusted so that particles having different sizes and/or electrical properties can be sorted sequentially.

Material and Fabrication

The fabrication of microfluidic separation chambers can be accomplished using known microfabrication techniques, including wet etching, reactive ion etching, conventional machining, photolithography, soft lithography, hot embossing, injection molding, laser ablation and plasma etching. For example, elastomeric materials such as polydimethylsiloxane (PDMS) and thermoset polyester (TPE) can be used for replica molding fabrication techniques. Thermoplastic materials such as polymethylmethacrylate (PMMA), polycarbonate (PC), cyclic olefin copolymer (COC), polystyrene (PS), polyvinylchloride (PVC), and polyethyleneterephthalate glycol (PETG) can be used with embossing technique. Thermoplastics such as PC and PMMA can also be used for injection molding. PS, PC, cellulose acetate, polyethyleneterephthalate (PET), PMMA, PETG, PVC, PC, and polyimide can be used with laser ablation techniques.

The electrode material in the separation chamber can be, but is not limited to, inert metals such as gold, platinum, and palladium to prevent electrochemical reactions and bubble formation. The electrodes can be deposited and patterned to the surfaces of microchannels using common metallization techniques employed in microfabrication such as deposition, sputtering, and stamp-printing, among others.

The invention claimed is:

1. A microfluidic particle sorting apparatus comprising a separation chamber, said separation chamber comprising:

a sample flow channel having a sample fluid inlet, a sample fluid outlet, a sample flow channel top wall, a sample flow channel bottom wall, and sample flow channel side walls, a side channel having a side channel fluid inlet and a side channel fluid outlet, a side channel top wall, a side channel bottom wall, and side channel side walls and configured to carry fluid and particles away from a flow path of the sample flow channel to the side channel outlet of the side channel, and a first pair of adjacent, coplanar, electrically coupled, electrodes separated by a gap having a gap distance wherein:

the first pair of electrodes form a part of either the sample flow channel top wall or the sample flow channel bottom wall of the sample flow channel and form an angle θ relative to a flow of fluid from the sample fluid inlet of the sample flow channel to the sample fluid outlet of the sample flow channel, an opening between the sample flow channel and the side channel overlaps at least a portion of the gap between the first pair of electrodes.

2. The microfluidic particle sorting apparatus of claim 1, wherein:

said side channel is positioned parallel to the sample flow channel;

the opening between the sample flow channel and the side channel is positioned between the sample fluid inlet and sample fluid outlet of the sample flow channel and between the side channel fluid inlet and side channel fluid outlet of the side channel;

fluid in the sample flow channel is configured to contact a fluid in the side channel through the opening between the sample flow channel and the side channel; and the opening between the sample flow channel and the side channel overlaps at least a portion of the gap between the first pair of electrodes.

3. The microfluidic particle sorting apparatus of claim 2, wherein angle θ is about 45°.

4. The microfluidic particle sorting apparatus of claim 2, comprising more than one separation chamber.

5. The microfluidic particle sorting apparatus of claim 2, wherein the gap distance is from about 1 mm to about 1 cm.

6. The microfluidic particle sorting apparatus of claim 2, and further comprising an electric power supply electrically coupled to said first electrode pair.

7. The microfluidic particle sorting apparatus of claim 2, and further comprising a second pair of adjacent, coplanar, electrically coupled, electrodes separated by a second gap having a second gap distance wherein said second pair of electrodes is located directly opposite across the separation chamber from said first pair of electrodes.

8. A microfluidic particle sorting apparatus comprising a separation chamber, said separation chamber comprising:

a separation zone having a top wall, a bottom wall, and side walls;

a first electrode pair comprised of electrically coupled first and second electrodes separated by a gap having a gap distance, said first electrode pair located in or on the bottom wall or top wall of the separation zone;

a sample fluid inlet configured to deliver a sample fluid into the separation zone;

a side channel fluid inlet configured to deliver a side channel fluid into the separation zone;

a sample fluid outlet configured to receive a first separation zone fluid from the separation zone;

a first side channel fluid outlet configured to receive a second separation zone fluid from the separation zone; and a second side channel fluid outlet configured to receive a third separation zone fluid from the separation zone; wherein:

the sample fluid inlet is located directly across the separation zone from the sample fluid outlet;

the side channel fluid inlet is positioned directly across the separation zone from the first and second side channel fluid outlets;

the sample fluid and side channel fluid entering the separation zone through the sample fluid inlet and side channel fluid inlet sequentially traverses the first electrode of the first electrode pair, the gap separating the first electrode pair, and the second electrode of the first electrode pair before entering one of the first side channel fluid outlet, the second side channel fluid outlet, or the sample fluid outlet; and the gap separating the first electrode pair comprises two or more linear sections forming angles θi, $\theta_2$, . . . θn with respect to a direction of flow from the sample fluid inlet to the sample fluid outlet where n is the number of linear sections.

9. The microfluidic particle sorting apparatus of claim 8, comprising more than one separation chamber.

10. The microfluidic particle sorting apparatus of claim 8, wherein the gap distance is from about 1 mm to about 1 cm.

11. The microfluidic particle sorting apparatus of claim 8, wherein angles θi, $\theta_2$, . . . θn are from about 0° to about 90°.

12. The microfluidic particle sorting apparatus of claim 8, and further comprising an electric power supply electrically coupled to said first electrode pair.

13. The microfluidic particle sorting apparatus of claim 8, and further comprising a second electrode pair comprised of electrically coupled electrodes separated by a second gap having a second gap distance, said second electrode pair being located directly across the separation zone from said first electrode pair.

14. The microfluidic particle sorting apparatus of claim 13, wherein said sorting apparatus comprises more than one separation zone.

15. The microfluidic particle sorting apparatus of claim 8, wherein the first electrode pair are adjacent, coplanar, electrically coupled, electrodes separated by the gap having the gap distance, and forming the angles relative to a flow of fluid from the sample fluid inlet of the sample flow channel to the sample fluid outlet of the sample flow channel.

16. The microfluidic particle sorting apparatus of claim 15, wherein a plane between the electrode pair is not orthogonal with the flow of fluid from the sample fluid inlet of the sample flow channel to the sample fluid outlet of the sample flow channel.

17. A microfluidic particle sorting apparatus comprising a separation chamber, said separation chamber comprising:

a separation zone having a top wall, a bottom wall, and side walls;

a first electrode pair comprised of electrically coupled, electrodes separated by a linear gap having a plurality of gap sections, the gap sections having two or more gap distances, said first electrode pair being located in or on the bottom wall or top wall of the separation zone;

a sample fluid inlet configured to deliver a sample fluid into the separation zone;

a side channel fluid inlet configured to deliver a side channel fluid into the separation zone;

a sample fluid outlet configured to receive a first separation zone fluid from the separation zone;

a first side channel fluid outlet configured to receive a second separation zone fluid from the separation zone; and a second side channel fluid outlet configured to receive a third separation zone fluid from the separation zone;

wherein:

the sample fluid inlet is located directly across the separation zone from the sample fluid outlet;

the side channel fluid inlet is positioned directly across the separation zone from the first and second side channel fluid outlets;

the sample fluid and side channel fluid entering the separation zone through the sample fluid inlet and side channel fluid inlet sequentially traverses a first electrode of the first electrode pair, the gap separating the first electrode pair, and a second electrode of the first electrode pair before entering one of first side channel fluid outlet, the second side channel fluid outlet, or the sample fluid outlet; and the linear gap separating the first electrode pair forms an angle θ with respect to a direction of flow from the sample fluid inlet to the sample fluid outlet and comprises two or more linear sections having two or more different gap distances.

18. The microfluidic particle sorting apparatus of claim 17, wherein said two or more different gap distances are independently from about 1 mm to about 1 cm.

19. The microfluidic particle sorting apparatus of claim 17, wherein angle θ is from about 0° to about 90°.

20. The microfluidic particle sorting apparatus of claim 17, and further comprising an electric power supply electrically coupled to said first electrode pair.

21. The microfluidic particle sorting apparatus of claim 17, and further comprising a second electrode pair comprised of electrically coupled electrodes separated by a second linear gap having a second variable gap distance, said second electrode pair being located directly across the separation zone from said first electrode pair.

22. The microfluidic particle sorting apparatus of claim 17, wherein said sorting apparatus comprises more than one separation zone.

23. The microfluidic particle sorting apparatus of claim 17, wherein the first electrode pair are adjacent, coplanar, electrically coupled, electrodes separated by the gap having the variable gap distance, and forming the angle relative to a flow of fluid from the sample fluid inlet of the sample flow channel to the sample fluid outlet of the sample flow channel.

24. The microfluidic particle sorting apparatus of claim 23, wherein a plane between the electrode pair is not orthogonal with the flow of fluid from the sample fluid inlet of the sample flow channel to the sample fluid outlet of the sample flow channel.

* * * * *